US005515685A

United States Patent [19]

Yanai et al.

[11] Patent Number: 5,515,685

[45] Date of Patent: May 14, 1996

[54] PULSE TUBE REFRIGERATOR

[75] Inventors: Masayoshi Yanai; Tomio Nishitani; Etsuji Kawaguchi, all of Moriyama, Japan

[73] Assignees: Iwatani Sangyo Kabushiki Kaisha; Iwatani Plantech Corporation, both of Osaka, Japan

[21] Appl. No.: 391,013

[22] Filed: Feb. 21, 1995

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 5,269,147 | 12/1993 | Ishizaki et al. | 62/6 |
| 5,275,002 | 1/1994 | Inoue et al. | 62/6 |
| 5,295,355 | 3/1994 | Zhou et al. | 62/6 |
| 5,335,505 | 8/1994 | Ohtani et al. | 62/6 |
| 5,412,952 | 5/1995 | Ohtani et al. | 62/6 |
| 5,440,883 | 8/1995 | Harada | 62/6 |

OTHER PUBLICATIONS

Peiyi, Shaowei, Zhongqi. "Analysis of Double Inlet Pulse Tube Refrigerator with a Valveless Stepped Piston Compressor", *Cryogenics V. 30, Sep. Supplement*, p. 253 (1990).

*Primary Examiner*—Ronald C. Capossela

*Attorney, Agent, or Firm*—Bacon & Thomas

[57] ABSTRACT

Two three-way valves (12) (13) of the rotary type are arranged in parallel in a high-pressure refrigerant gas passage (15) of a compressor (7). A high-temperature end portion of a cold accumulator (2) is communicated with one three-way valve (12) of the rotary type through a main gas passage (19) as well as a high-temperature end of a pulse tube (1) is communicated with the other three-way valve (13) of the rotary type through a sub gas passage (20). A low-pressure port of each three-way valve (12)(13) is communicated with a low-pressure refrigerant gas return passage (17) of the compressor (7) respectively. A flow regulating member (21) is interposed in the sub gas passage (20). Both the three-way valves (12) (13) are synchronously rotated. A valve opening-closing timing of the one three-way valve (12) or (13) is adjustably changed relative to that of the other three-way valve (13) or (12).

6 Claims, 4 Drawing Sheets

PULSE TUBE REFRIGERATOR

BACKGROUND OF THE INVENTION

1. Field of the Invention

The present invention relates to a pulse tube refrigerator adapted to generate the cold at an endothermic portion by connecting a cold accumulator and a pulse tube to each other so as to supply and discharge gas to and from a compressor, and more specifically to a double inlet pulse tube refrigerator adapted to switch gas supply from a compressor to a high-temperature side of a pulse tube.

2. Description of Prior Art

Conventionally, as a pulse tube refrigerator which is capable of obtaining a lower attainable temperature there has been proposed a double inlet pulse tube refrigerator illustrated in FIG. 4 (disclosed in the scientific essay "CRYOGENICS" September 1990).

In this double inlet pulse tube refrigerator, a low-temperature end (51) of a pulse tube (50) is communicated with a low temperature end (53) of a cold accumulator (52) through an endothermic connection pipe (54) serving as a cold head so that gas to be supplied from a compressor (55) to a high-temperature end (57) of the cold accumulator (52) through a refrigerant gas passage (56) can be introduced from the low-temperature end (51) of the pulse tube (50) toward a high-temperature end (58) thereof through the cold accumulator (52) and the endothermic connection pipe (54), a phase shifter comprising a needle valve (59) and a buffer tank (60) is arranged in the high-temperature end (58) of the pulse tube (50), a branch gas passage (61) branched off from the refrigerant gas passage (56) is connected to a passage portion between the high-temperature end of the pulse tube (50) and the buffer tank (60), a needle valve (62) is arranged in the branch gas passage (61), and water coolers (63) (64) are disposed at the high-temperature ends of the cold accumulator (52) and the pulse tube (50) so as to apply a water cooling to the high-temperature end portions of the cold accumulator (52) and the pulse tube (50).

3. Problems Presented by the Prior Art

In the above-mentioned double inlet pulse tube refrigerator, since the buffer tank (60) is so arranged as to be communicated with the high-temperature end (58) of the pulse tube (50), there is a problem that the whole of the refrigerator becomes large in size. Further, since the needle valve (59) is disposed between the high-temparature end of pulse tube (50) and the buffer tank (60) and the needle valve (62) is arranged in the branch gas passage (61) which connects a passage portion between the high-temperature end of the pulse tube (50) and the buffer tank (60) to the refrigerant gas passage (56), there is also such a problem that the gas flow is disturbed by the needle valves (59)(62). Further, in this double inlet pulse tube refrigerator, since a reciprocating type compressor section is in rigid contact with a cold generating section so that vibration of the compressor is transmitted to the cold generating section, there is also a problem that this refrigerator can not be applied for cooling such machines and component members as to hate the vibrations.

The present invention is directed to solving those problems. It is an object of the present invention to provide a pulse tube refrigerator which doesn't need a buffer tank, is small in size and light in weight, can obtain a low attainable temperature and has a high cooling efficiency, and vibrates extremely a little.

SUMMARY OF THE INVENTION

For accomplishing the above object, the present invention is characterized in that two three-way valves of the rotary type are arranged in parallel in a high-pressure refrigerant gas passage of the compressor, the high-temperature end portion of the cold accumulator is communicated with one three-way valve of the rotary type through a main gas passage, the high-temperature end of the pulse tube is communicated with the other three-way valve of the rotary type through a sub gas passage, a low-pressure port of each thee-way valve of the rotary type is communicated with a low-pressure refrigerant gas return passage of the compressor respectively, a flow regulating member is interposed in the sub gas passage, both the three-way valves of the rotary type are synchronously rotated, and a valve opening-closing timing of the one three-way valve of the rotary type is adjustably changed relative to that of the other three-way valve of the rotary type.

According to the present invention, since two three-way valves of the rotary type are arranged in parallel in the high-pressure refrigerant gas passage of the compressor, the high-temperature end portion of the cold accumulator is communicated with one three-way valve of the rotary type through the main gas passage, the high-temperature end of the pulse tube is communicated with the other three-way valve of the rotary type through the sub gas passage, the low-pressure port of each thee-way valve of the rotary type is communicated with the low-pressure refrigerant gas return passage of the compressor respectively, the flow regulating member is interposed in the sub gas passage, both the three-way valves of the rotary type are synchronously rotated, and the valve opening-closing timing of the other three-way valve of the rotary type is adjustably changed relative to that of the one three-way valve of the rotary type, it is possible to lower an attainable temperature without arranging the buffer tank and to provide a pulse tube refrigerator which is small in size and has a high refrigeration generating efficiency.

DETAILED DESCRIPTION OF PREFERRED EMBODIMENT

Figure 1:
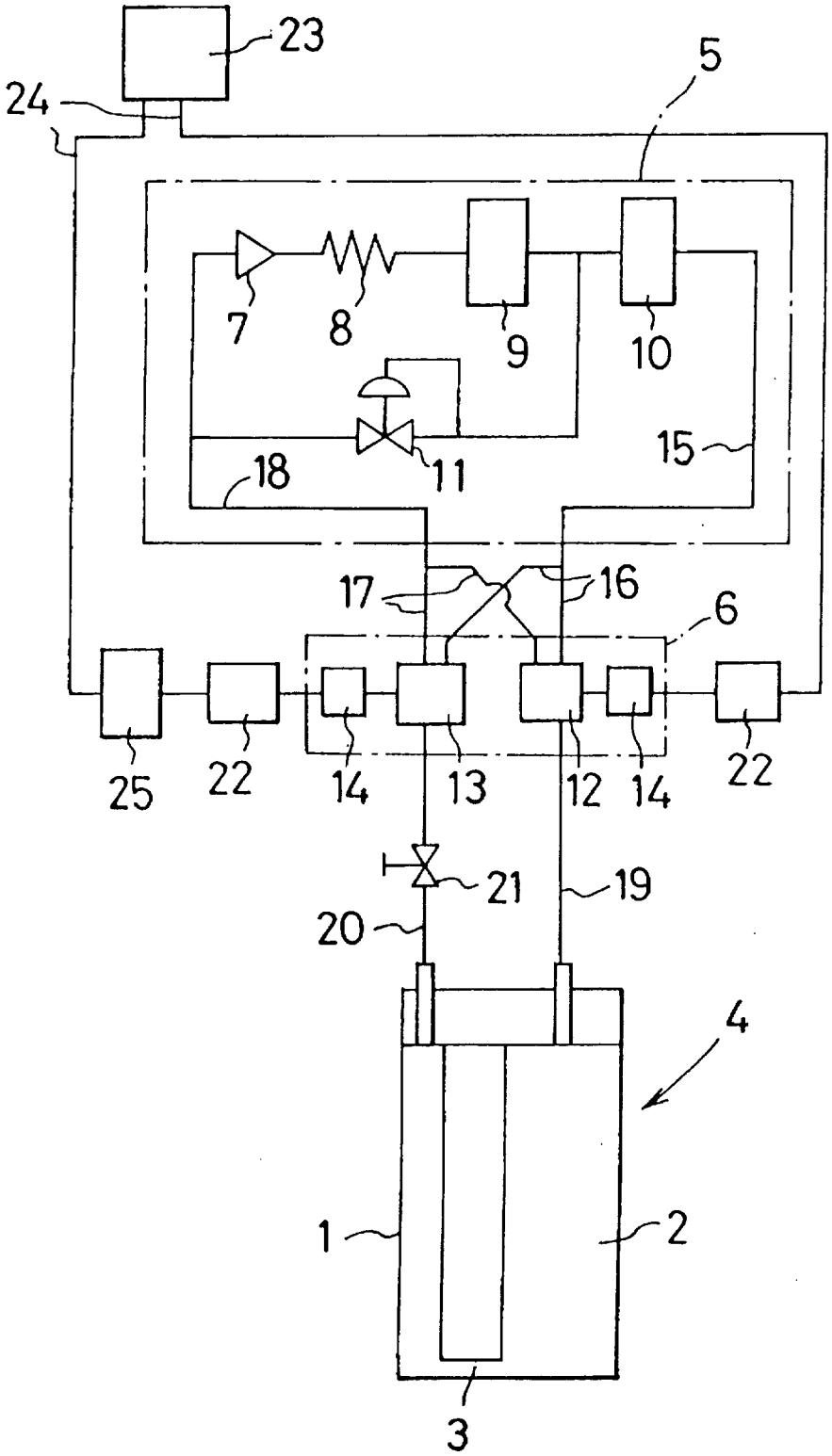
FIG. 1 is a schematic constitution view of a pulse tube refrigerator showing an embodiment of the present invention.
Figure 2:
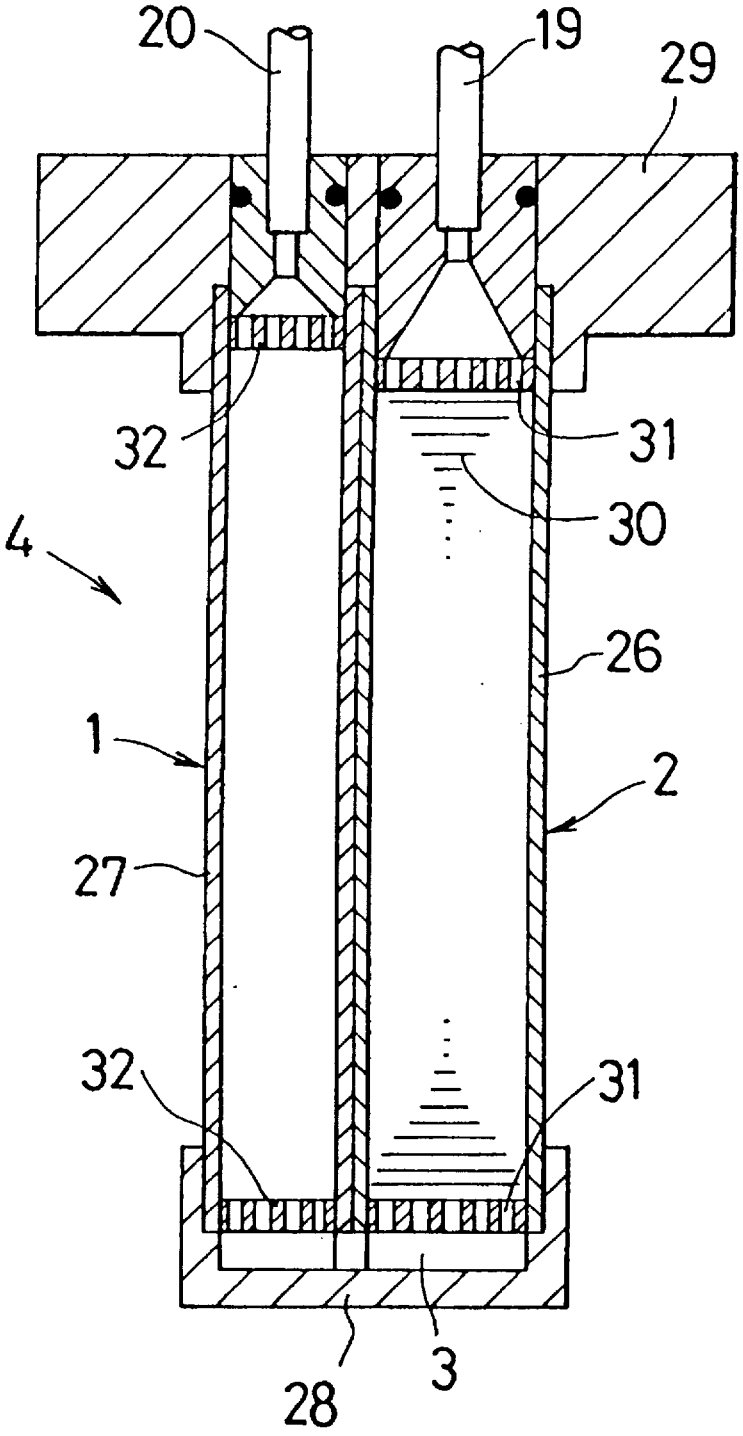
FIG. 2 is a vertical sectional view of a cold generating section of the embodiment of the present invention.

This pulse tube refrigerator comprises a cold generating section (4) constituted by communicating one end portions of both a pulse tube (1) and a cold accumulator (2) with each other through an endothermic connection pipe (3), a compressor unit (5) and a rotary valve unit (6) for controlling the switching of supply and discharge of high-pressure gas generated in the compressor unit (5) to and from the cold generating section (4).

The compressor unit (5) comprises a compressor (7), a cooler (8), an oil separator (9), an oil adsorber (10) and a pressure keeping valve (1), and the rotary valve unit (6)

comprises two three-way valves (12) (13) of the rotary type and their respective valve driving motors (14). A high-pressure refrigerant gas passage (15) conducted from the adsorber (10) is connected to each first port of the three-way valves (12) (13) of the rotary type through flexible hoses (16), and flexible hoses (17) conducted from second ports of the three-way valves (12) (13) of the rotary type are communicated with the compressor (7) through a low-pressure refrigerant gas return passage (18).

A third port of the first three-way valve (12) of the rotary type is communicated with a high-temperature end of the cold accumulator (2) through a main gas passage (19) made of a flexible hose, and a third port of the second three-way valve (13) of the rotary type is communicated with a high-temperature end of the pulse tube (1) by a sub gas passage (20) made of a flexible connection pipe via a needle valve serving as a flow regulating member (21). Each of valve driving motors (14) for the three-way valves (12) (13) of the rotary type comprises a stepping motor. Each valve driving motor (14) is adapted to be driven by a motor power source (22) (22) respectively. A driving circuit (24) is constituted by connecting each motor power source (22) (22) to a pulse generator (23). Thereby, both the three-way valves (12) (13) of the rotary type can operate synchronously.

A phase shifter (25) is arranged between the motor power source (22) and the pulse generator (23) in the driving circuit (24) of the valve driving motor (14) for driving the second three-way valve (13) of the the rotary type having the third port connected to the high-temperature end of the pulse tube (1), so that valve opening-closing phase angles (valve opening-closing timings) of the first three-way valve (12) of the rotary type connected to the cold accumulator (2) and of the second three-way valve (13) of the the rotary type connected to the pulse tube (1) can be adjustably changed.

The cold generating section (4) is constituted by arranging two stainless pipes (26) (27) in parallel, fitting their lower end portions into a copper end cap (28) and fitting their upper end portions into an attachment flange (29) for radiation. The cold accumulator (2) is constituted by stacking stainless or copper mesh members (30) within one stainless pipe (26) and arranging flow straightening plates (31) at its upper and lower opposite end portions. The pulse tube (1) is constituted by arranging flow straightening plates (32) at upper and lower opposite end portions of the other stainless pipe (27).

The endothermic connection passage (3) is constituted by mounting a gas distributing plate and a spacer to the copper end cap (28) so as to communicate the cold accumulator (2) and the pulse tube (1) with each other.

When the sub gas passage (20) is communicated with the high-pressure gas passage (15) of the compressure (7) by the switching operation of the second three-way valve (13) of the rotary type communicated with the pulse tube (1), the high-pressure refrigerant gas is supplied from the high-temperature end to the pulse tube (1) under a flow control by the flow regulating member (21), so that the pressure within the pulse tube starts to increase. Then, after a lapse of a little time from the communication of the sub gas passage (20), the first three-way valve (12) of the rotary type communicated with the cold accumulator (2) is switched so that the main gas passage (19) is communicated with the high-pressure gas passage (15). Therefore, the high-pressure refrigerant gas is supplied to the high-temperature end of the cold accumulator (2), the supplied high-pressure refrigerant gas reaches the low-temperature end of the pulse tube (1) through the cold accumulator (2), and the pressure within the pulse tube (1) is increased higher by the high-pressure refrigerant gas supplied from the sub gas passage (20) and the high- pressure refrigerant gas supplied from the main gas passage (9).

Then, although the sub gas passage (20) is communicated with the low-pressure gas return passage (18) by the switching over of the second three-way valve (13) of the rotary type before the pressure within the pulse tube (1) becomes a maximum pressure, since the flow regulating member (21) is interposed in the sub gas passage (20), an amount of the refrigerant gas flown out of the pulse tube (1) is limited so that the high-pressure gas within the pulse tube (1) is increased to a maximum pressure as well as the gas is moved from the low-temperature end to the high-temperature end.

Subsequently, the main gas passage (19) is communicated with the low-pressure refrigerant gas return passage (18) by the switching operation of the first three-way valve (12) of the rotary type communicated with the cold accumulator (2), the high-pressure gas within the pulse tube (1) is expanded to low-pressure gas and returned to a low-pressure section of the compressor (7) while generating the cold.

The above-mentioned operations are repeated. These operations correspond to the Stirling refrigerating cycle.

In the pulse tube refrigerator constituted in that way, since the cold generating section (4) is not provided with any movable portions and the main gas passage (19) for communicating the rotary valve unit (6) which controls the supply and discharge of the refrigerant gas to and from the cold accumulator (2), with the cold generating section (4) is formed by a flexible hose, it is possible to provide a refrigerator which doesn't generate any vibration.

Since the phase shifter (25) is arranged in the driving circuit (24) of the second three-way valve (13) of the rotary type to be communicated with the high-temperature end of the pulse tube (1) as well as the second three-way valve (13) of the rotary type to be communicated with the pulse tube (1) and the first three-way valve (12) of the rotary type to be communicated with the high-temperature end of the cold accumulator (2) are adapted to be operated based on a phase differential which is adjustable, it is possible to readily obtain an ideal phase differential according to an aimed temperature range.

Incidentally, the gas supply and discharge cycle may be changed for regulation by constituting the driving motors (14) for both the three-way valves (12) (13) of the rotary type so as to be changeable in rotative speed to change the switching operation speeds of the three-way valves (12) (13) of the rotary type.

Further, though the above-mentioned embodiment employs the phase shifter (25) arranged in the driving circuit for the second three-way valve (13) of the rotary type, the phase shifter (25) may be arranged in the driving circuit for the first three-way valve (12).

Figure 3:
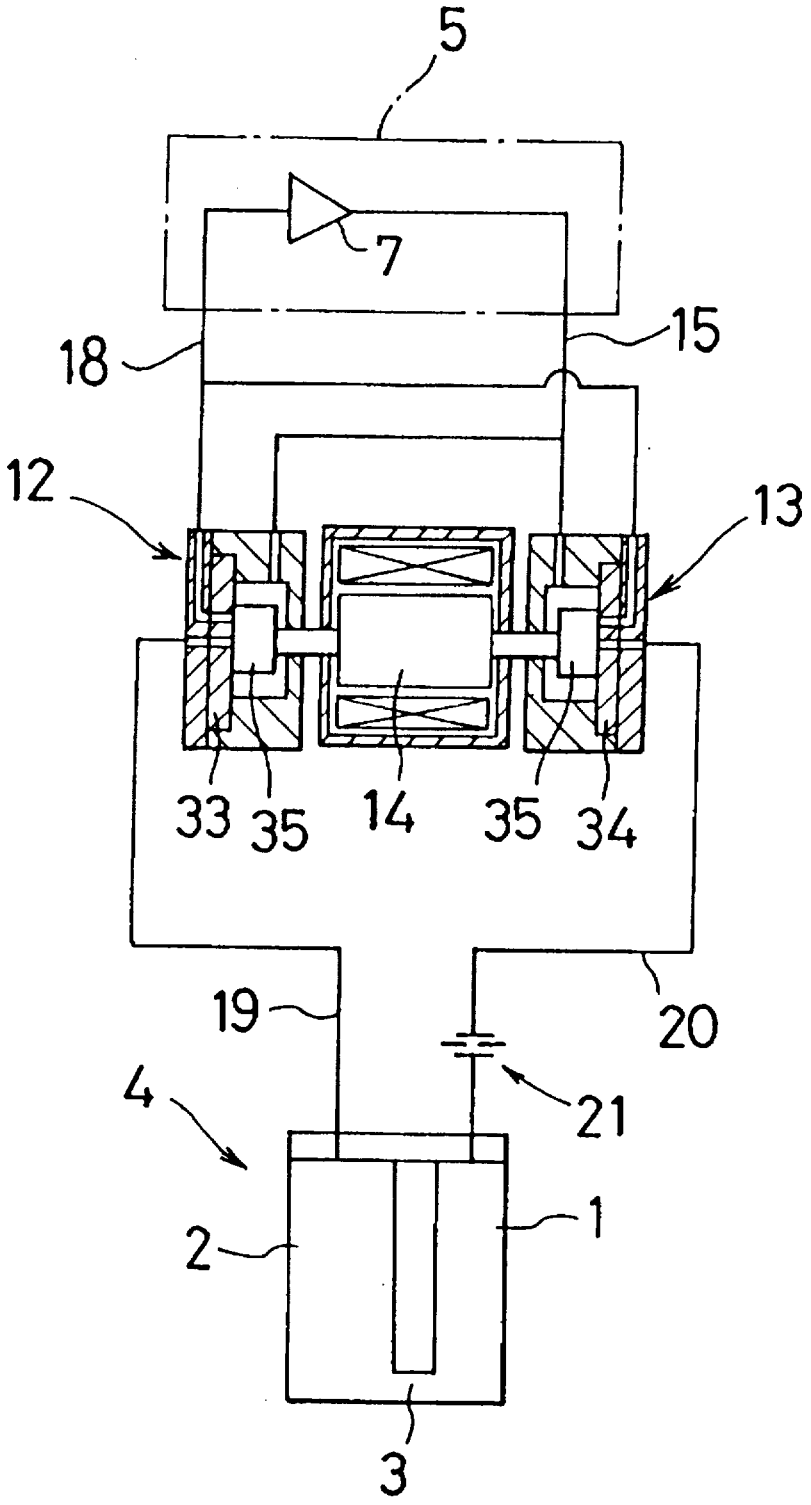
FIG. 3 is a schematic constitution view showing another embodiment of a driving mechanism for a three-way valve of the rotary type.
Figure 4:
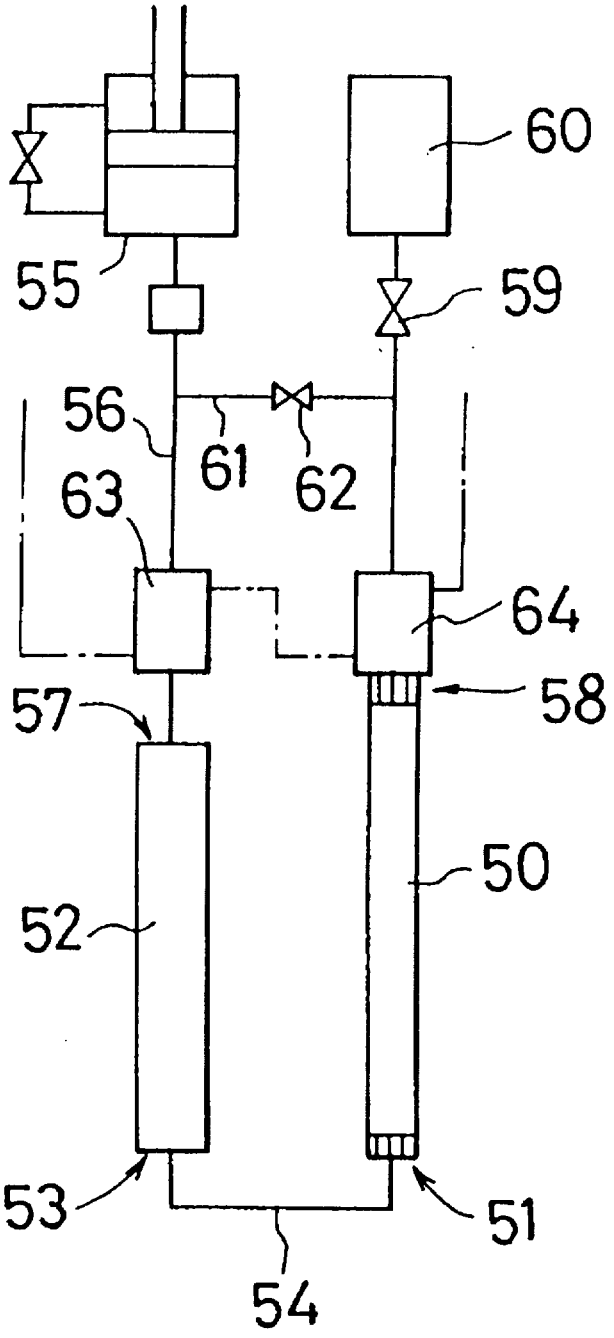
FIG. 4 (PRIOR ART)
FIG. 4 is a schematic constitution view of a conventional double inlet pulse tube refrigerator.

FIG. 3 shows another embodiment of the present invention, wherein two three-way valves (12)(13) of the rotary type are adapted to be driven by the same driving motor (14). While a valve plate (33) of the first three-way valve (12) of the rotary type communicated with the high-temperature end of the cold accumulator (2) is stationary as well as a valve plate (34) of the second three-way valve (13) of the rotary type communicated with the high-temperature end of the pulse tube (1) is adjustably rotatable about the rotation axis of the rotary valve member (35), the valve opening-closing operation timing of the second three-way valve (13) of the rotary type is adjustable in phase relative to the valve opening-closing operation timing of the first three-way valve (12) of the rotary type. An orifice as the flow regulating member (21) is interposed in the sub gas passage (20).

Incidentally, though the above-mentioned another embodiment employs the valve plate (33) of the first three-way valve (12) made stationary and the valve plate (34) of the second three-way valve (13) made adjustably rotatable, the valve plate (33) of the first three-way valve (12) may be made adjustably rotatable and the valve plate (34) of the second three-way valve (13) may be made stationary.

As noted above, according to the present invention, since the high-temperature end of the pulse tube is adapted to be switchably communicated with the high-pressure refrigerant gas passage and the low-pressure refrigerant gas passage of the compressor through the second three-way valve of the rotary type and the flow regulating member is arranged in the sub gas passage between the pulse tube and the second three-way valve of the rotary type, the interior of the pulse tube can be switchably connected to the low-pressure refrigerant gas passage and to the high-pressure refrigerant gas passage by the rotational operation of the rotary valve. Therefore, since the pressure change accompanied with that switching serves as the double inlet pulse tube refrigerator, it becomes possible to obtain the pulse tube refrigerator which is light in weight, has a high refrigeration generating efficiency and vibrates extremely a little by omitting the buffer tank.

Further, since the cold accumulator and the pulse tube are switchably communicated with the high-pressure refrigerant gas passage and the low-pressure refrigerant gas return passage of the compressor through the two three-way valves of the rotary type which operate synchronously, respectively and the opening and closing operation timings of the three-way valve of the rotary type which controls the pulse tube side and of the three-way valve of the rotary type which controls the cold accumulator side are changeable, it is possible to obtain the ideal phase differential according to the aimed temperature range for the refrigerator.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be considered as being included therein.

What is claimed is:

1. A pulse tube refrigerator comprising:

a pulse tube having a low-temperature end and a high-temperature end;

a cold accumulator having a low-temperature end and a high-temperature end;

an endothermic connection passage interconnecting the low-temperature end of said cold accumulator to the low-temperature end of said pulse tube;

a compressor having a high-pressure port and a low-pressure port;

a low-pressure refrigerant gas return passage connected to the low-pressure port of said compressor;

a refrigerant gas passage connecting the high-pressure port of said compressor to the high-temperature end of said cold accumulator, said refrigerant gas passage being adapted to be supplied with a refrigerant gas from the compressor to be delivered to the high-temperature end of said pulse tube through said cold accumulator and said endothermic connection passage;

first and second three-way valves arranged in parallel in said refrigerant gas passage, each of said first and second three-way vanes having an associated low-pressure port;

a main gas passage fluidly communicating said first three-way vane with the high temperature end of said cold accumulator;

a sub gas passage fluidly communicating said second three-way vane with the high-temperature end of said pulse tube;

means for interconnecting the low-pressure port of each of said first and second three-way valves to the low-pressure refrigerant gas return passage;

a flow regulating member interposed in the sub gas passage;

means for synchronously shifting said first and second three-way valves; and means for adjustably changing opening/closing timings of one of said first and second three-way valves relative to the other of said first and second three-way valves.

2. The pulse tube refrigerator according to claim 1, wherein said means for synchronously shifting comprises a plurality of driving motors for individually driving said first and second three-way valves respectively wherein each of said driving motors is constituted by a stepping motor and said means for adjustably changing opening/closing timings comprises a pulse generator for generating pulses delivered to said driving motors whereby the opening/closing timing of each of said first and second three-way valves are adjustably changed by regulating the pulses transmitted to each stepping motor.

3. The pulse tube refrigerator according to claim 2, further comprising: means for changing a rotating speed of each said driving motor.

4. The pulse tube refrigerator according to claim 1, wherein each of said first and second three-way valves has an associate valve plate, said means for synchronously shifting comprises a single driving motor for synchronously driving both of said first and second three-way valves and at least one valve member drivingly connected to said single driving motor; and said means for adjustably changing opening/closing timings comprises means for retaining the valve plate of one of said first and second three-way valves stationary and for displacing the valve plate of the other of said first and second three-way valves by moving said at least one valve member by said single driving motor so that the opening/closing timings of said first and second three-way valves are adjustably changed.

5. The pulse tube refrigerator according to claim 4, further comprising:

means for changing a rotating speed of said single driving motor.

6. The pulse tube refrigerator according to claim 1, wherein each of said first and second three-way valves comprises a rotary valve.

* * * * *